United States Patent [19]

De Nittis

[11] Patent Number: 5,049,107

[45] Date of Patent: Sep. 17, 1991

[54] SOUND-BOX DEVICE

[75] Inventor: Nicola De Nittis, Bologna, Italy

[73] Assignee: Malbo S.R.L., Bologna, Italy

[21] Appl. No.: 502,118

[22] Filed: Mar. 29, 1990

[30] Foreign Application Priority Data

Mar. 30, 1989 [IT] Italy ..... 4781/89[U]
Dec. 28, 1989 [IT] Italy ..... 4990/89[U]

[51] Int. Cl.[5] ..... A63H 5/00

[52] U.S. Cl. ..... 446/397; 273/58 E; 446/484

[58] Field of Search ..... 446/397, 297, 303, 484; 273/58 E; 84/600, 644, 670, 718, DIG. 7, 672, 678

[56] References Cited

U.S. PATENT DOCUMENTS 4,398,892 8/1983 Solomon ..... 84/DIG. 7
4,527,688 7/1985 Jones et al. ..... 446/76 X
4,551,114 11/1985 Hyman et al. ..... 446/397
4,706,536 11/1987 Sanders ..... 84/423 R X
4,801,141 1/1989 Rumsey ..... 273/58 E X
4,936,780 6/1990 Cogliano ..... 446/397 X

FOREIGN PATENT DOCUMENTS 1172585 6/1964 Fed. Rep. of Germany .
1601935 10/1970 France .
2208028 2/1989 United Kingdom .
2214832 9/1989 United Kingdom .

*Primary Examiner*—Mickey Yu
*Attorney, Agent, or Firm*—Herbert Dubno

[57] ABSTRACT

A sound box has a generally spherical container provided on its surface with graphic fields associated with respective contacts connected to a microprocessor within the container, a loudspeaker and circuitry which, upon pressing of one of the fields generates a sound sequence representing the graphic depiction of that field.

20 Claims, 2 Drawing Sheets

SOUND-BOX DEVICE

FIELD OF THE INVENTION

The present invention relates to a sound-box device. Various devices, such as carillons and the like, which can produce simple musical tunes are currently known. Such devices are generally actuated mechanically, for example by rotating a cylinder which rotates a series of metallic laminae.

Such devices have very limited sound possibilities; in particular they can produce only one musical tune and furthermore require the recharge of the actuation mechanism after every execution. This currently limits the distribution of said devices.

OBJECTS OF THE INVENTION

The object of the present invention is to overcome the above problem by providing a sound-box device which allows automatic production of a wide variety of musical tunes or sound patterns which can be easily selected for listening by the user.

A further object of the present invention is to provide a sound-box device which is simple in concept, safely reliable in operation and versatile in use.

SUMMARY OF THE INVENTION

These objects are achieved, according to the invention, by the present sound-box device, which comprises a container, an electronic control element which is arranged inside said container and is adapted to produce a plurality of electric signals which can be transduced into sound signals ordered according to at least one sound sequence, at least one sensor element which is arranged on the internal surface of said container, is connected to said electronic control element and is adapted to be actuated on a corresponding symbol provided on the outer surface of said container for selecting said sound sequence, a loudspeaker accommodated inside said container for the emission of said sound signals, and means for the electric power supply of said electronic control element and of said loudspeaker.

BRIEF DESCRIPTION OF THE DRAWING

The details of the invention will become apparent from the detailed description of a preferred embodiment of the sound-box device, illustrated only by way of non-limitative example in the accompanying drawing, wherein.

DESCRIPTION OF THE PREFERRED EMBODIMENTS

Figure 2:
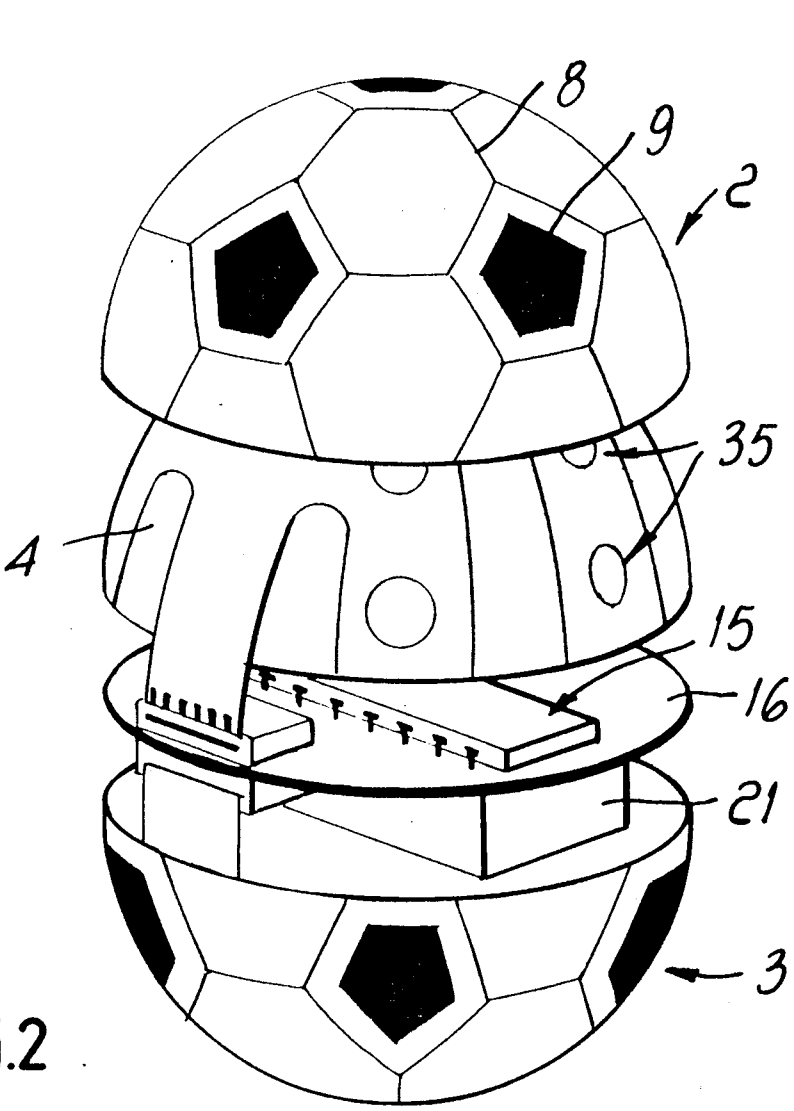
FIG. 2 is a view thereof in operative configuration.
Figure 1:
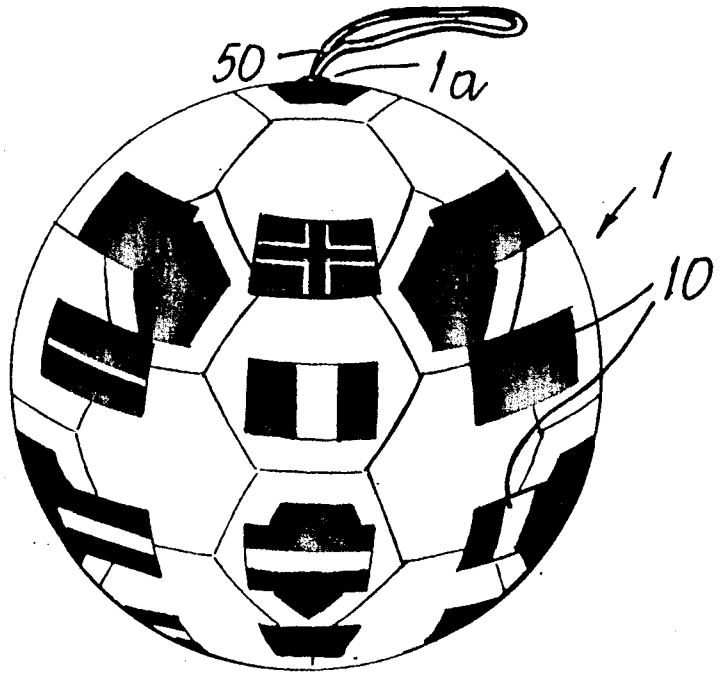
FIG. 1 is a partially exploded schematic view of the sound-box device according to the invention.
Figures 3, 4:
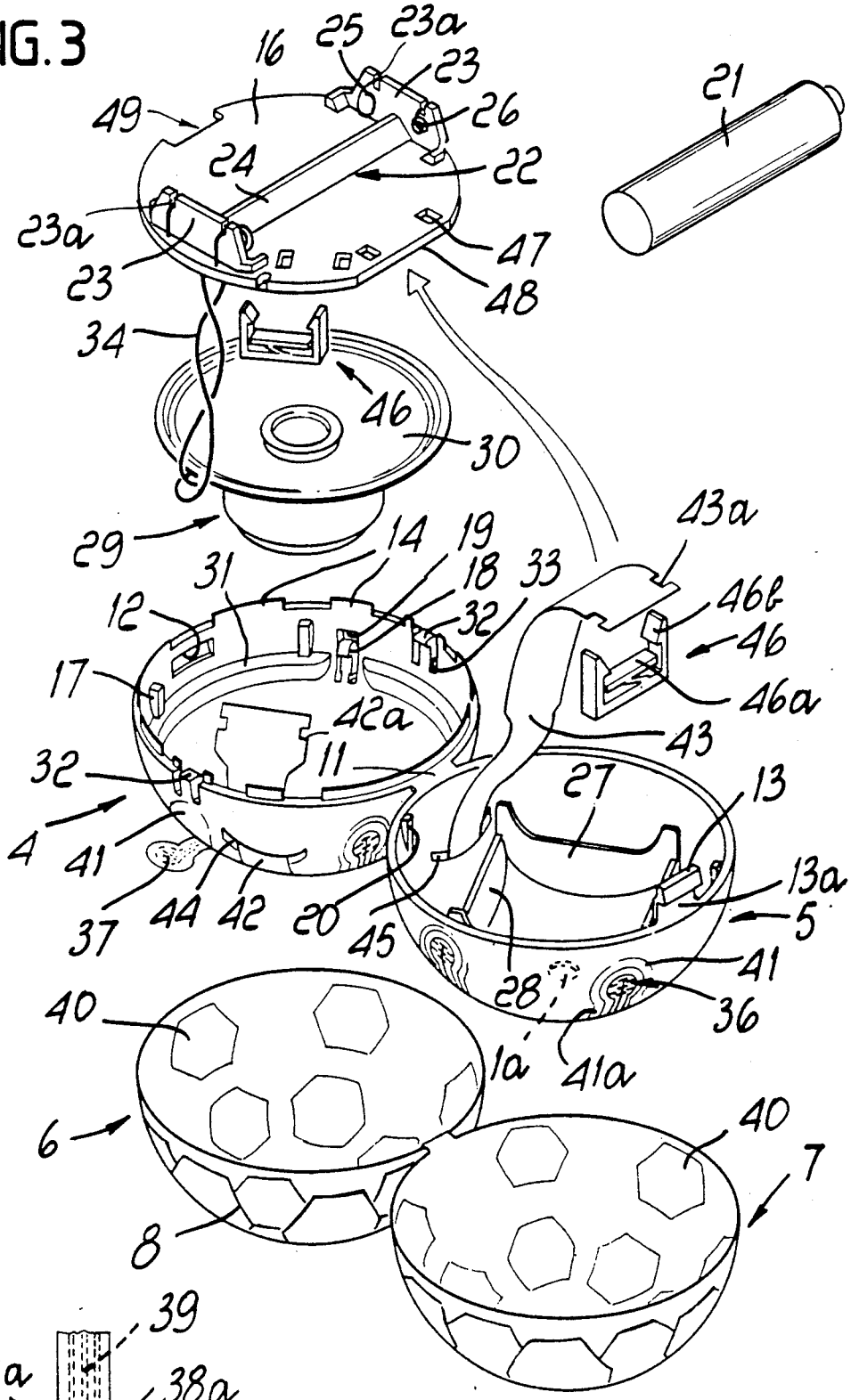
FIG. 3 is an exploded perspective view of the device.
FIG. 4 is a detail view of the sensor element.

With particular reference to the above figures, the sound-box device comprises a container 1 advantageously consisting of a first container portion and a second container portion which are adapted to be mutually associated by suitable sontainer portion connection means. The first container portion is advantageously constituted by a first half-shell 2 and the second container portion is advantageously constituted by a second half-shell 3 which are adapted to be mutually associated by suitable container portion connection means. Each of said half-shells 2, 3 defines a hemisphere, so that the container has an overall spherical shape in operative configuration.

The container 1 has a hole 1*a* through which an attachment or coupling string 50 of the device passes.

Each container portion may be comprised of a supporting frame portion and a related covering membrane portion which are both mutually attached by suitable coupling means. In the preferred embodiment shown in the figures, for example, the half-shells 2, 3 are advantageously constituted by a supporting frame made of significantly rigid material, in particular provided by molding in plastic material in the shape of hemispherical domes 4, 5. The domes 4, 5 of the supporting frame are externally covered by related membranes 6, 7 made of deformable plastic material which are adapted to act as covering.

The outer surface of the membranes 6, 7 conveniently has a grid with polygonal elements 8 drawn thereon; said elements partly enclose pentagonal portions 9 of a dark color, so as to give the container 1 the appearance of a soccer ball. A plurality of graphic symbols 10, such as for example flags of various national states, is furthermore defined on said surface.

The membranes 6, 7 are rigidly associated with the domes 4, 5 by means of conventional double-adhesive elements, not illustrated in the drawing, or by analogous coupling means.

The domes 4, 5 are joined to one another at their edges for a portion 11 adapted to act as a hinge. In a diametrically opposite position with respect to said hinge, the first dome 4 has a slot 12 which is adapted to be elastically engaged by a tooth 13 defined at the end of a tab 13*a* which extends from the corresponding edge of the second dome 5. The domes 4, 5 can be connected by any other suitable container portion connection means. A plurality of teeth 14 furthermore extends along the edge of the first dome 4; the thickness of said teeth is half that of the dome itself, and the teeth 14 are adapted to act as centering means in the coupling of the two domes 4, 5.

Arranged inside the container 1 there is an electronic control element 15 provided with a microprocessor which is per se known and is adapted to drive the device and produce a plurality of electric signals which can be transduced into sound signals ordered in a plurality of sound sequences.

The control element 15 is advantageously mounted on a base 16 arranged substantially at the connecting plane of the half-shells 2, 3. Said base 16 has a circular shape and peripherally rests on a plurality of shaped teeth 17 which are angularly distributed on the inner surface of the first dome 4. The base 16 is locked elastically along the outer edge by a plurality of engagement teeth 18 defined by the dome 4 at related notches 19; said base 16 is furthermore locked by a plurality of dowels 20 which protrude from the edge of the second dome 5.

It will be noted that the control element 5 can suitably be mounted upon any type of supporting means which are fixed to the inside of the container 1 by appropriate supporting locking means.

Electric power supply means advantageously constituted by a pair of electric batteries 21 for supplying power to the device, are intended to be provided inside the container 1 and can advantageously be mounted on the base 16. The batteries 21 can be accomodated in the seats defined by a support 22 which defines a pair of heads 23 joined by a partition 24 intended to separate said batteries. A respective pair of spring elements 25, 26, adapted to act as electric contacts for connection to the batteries 21, are associated on the heads 23 at notches 23*a*.

The batteries 21 are secured in their related seats, after the closure of the container 1, by a pair of partitions 27 defined inside the second dome 5 in a transverse direction with respect to said batteries; the partitions 27 are reinforced by longitudinal ridges 28.

Sound signal emission means advantageously constituted by a loudspeaker 29 for emitting the sound signals is accommodated in loudspeaker accommodation means inside the container, advantageously inside the first half-shell 2, and is arranged with its emission diaphragm 30 directed toward the inside of the container 1, in practice advantageously facing the base 16. Advantageously, the loudspeaker accommodation means are such that the loudspeaker 29 is centered on an annular ridge 31 defined on the internal surface of the dome 4, parallel to its edge, and is locked elastically by a plurality of engagement teeth 32 defined by said dome 4 at related notches 33. The loudspeaker 29 is connected to the control element 15 by means of a pair of electric wires 34.

Sensor means communicating with the electronic control element 15 for activating or selecting the electric signals transducible into sound signals are associated with the container 1 such that the sensor means are activated at the outside surface of the container 1. In the preferred embodiment shown in the figures, such sensor means are advantageously constituted by a plurality of sensor elements 35 applied on the outer surface of the domes 4, 5; said sensor elements are connected to the electronic control element 15 and are adapted to be actuated on corresponding graphic symbols 10 defined on the outer surface of the container 1 for selecting related sound sequences. The sensor elements 35 are constituted by a membrane keyboard formed by a plurality of contact switches 36 which are electrically connected in parallel to the electronic control element 15. The keyboard is provided by depositing conducting material on a pair of films 37 intended to be glued respectively on the domes 4, 5.

More precisely, the switches 36 are constituted by a circular external terminal 38 and by an internal terminal 39 which extend from respective conductors arranged so as to form a radial pattern on the film 37; the terminals 38, 39 of the switches 36 have respective branchings 38*a*, 39*a* which interpenetrate so as to facilitate the closure of the electric contact. Said contact is closed by contacting the switches 36 with respective graphite layers 40 applied on the internal surface of the membranes 6, 7 at respective graphic symbols 10.

The switches 36 are applied at respective flattened portions 41 defined on the outer surface of the domes 4, 5; said flattened portions 41 are distributed along substantially meridian lines, at which the surface of the dome has chamfers 41*a* of reduced width with respect to said flattened portions. Said flattened portions 41 therefore define an interspace between each switch 36 and the covering membrane 6, 7, so that the electric contacts are normally not closed.

The two halves of the keyboard are connected to the control element 15 by means of related loose strips 42, 43 of the films 37; said strips insert in the domes 4, 5 through respective slots 44, 45. The ends of the strips 42, 43 are retained, by means of opposite recesses 42*a*, 43*a*, on a pair of couplings 46.

Said couplings 46 have a tab 46*a* for the elastic securing of the strips 42, 43 and are adapted to be engaged, by means of a pair of teeth 46*b*, in holes 47 provided on the base 16. The heads 23 of the support 22 of the batteries 21 couple on the base 16 in a similar manner.

The couplings 46 are fixed on the face of the base 16 which is directed toward the first half-shell 2, i.e. on the side opposite to the batteries 21. A chamfer 48 is provided on the base 16 to allow the passage of the strip 43, which extends from the second half-shell 3, to the coupling region. The base 16 is furthermore provided with a recess 49 at the region where the tooth 13 couples to the slot 12.

The operation of the described device is easily understandable. By pressing the outer surface of the container 1 at one of the symbols 10 defined thereon, a corresponding sound sequence is emitted. The deformation of the covering membrane 6, 7 of the container in fact places the graphite layer 40 arranged below each symbol 10 in contact with the respective switch 36, closing the electric contact between the related terminals 38, 39. The branchings 38*a*, 39*a* of the terminals ensure the closure of the electric contact even in case of an imperfect pressing of the graphic symbols 10.

In a preferred embodiment of the device, the selectable sound sequences are constituted by the national anthems of a plurality of nations whose flags are correspondingly defined on the outer surface of the ball so as to constitute said symbols 10. In particular, the nations provided may be those which participate in sports championships and the like.

It is naturally possible to provide that said sound sequences reproduce musical tunes or sounds of different kinds, such as for example animal sounds, sounds of musical instruments, characteristic voices of celebrities and the like.

Different graphic symbols, such as for example pictures of animals, musical instruments, celebrities and the like, can be provided correspondingly on the outer surface of the container of the device.

The outer shape of the container of the device may equally be different from the one described. In particular, said container may have a generally rounded shape, such as that of a rugby-ball, or the shape of a polyhedron or of other similar geometrical solids.

To conclude, the device according to the invention allows to produce a plurality of sound patterns or musical tunes, matching their selection with appropriate graphic representations capable of easily recalling them.

The device has a very small size by virtue of the optimum arrangement of the components inside the container; it furthermore has no visible actuation elements. The device is conveniently provided with a string 50, inserted in the hole 1*a* of the container, which facilitates its transport for example hung from the wrist or neck.

The device is very easy to use, since it is sufficient to actuate the contact switches concealed below the covering to obtain the emission of the sound patterns or musical tunes.

The device can be easily opened to allow the insertion of the batteries. For this purpose it is sufficient to exert pressure on the edge of the second half-shell 3 at the tab 13*a*, so as to cause the disengagement of the tooth 13 from the slot 12 provided on the first half-shell 2.

In the practical embodiment of the invention, the materials employed, as well as the shape and dimensions, may be any according to the requirements.

I claim:

1. A sound box device comprising:

a substantially spherical container having an outside surface, a first container portion and a second container portion, a first hemispherical half-shell defined by said first container portion, a second hemispherical half-shell defined by said second container portion, connecting means connecting said first container portion to said second container portion, wherein said first container portion and said second container portion each comprise:

a supporting frame portion, a deformable covering membrane portion, coupling means attaching said deformable covering membrane portion to said supporting frame portion, at least one base connected to said first container portion, at least one control element having a microprocessor and being mounted on said base, said microprocessor producing a plurality of electric signals transduced into sound signals for producing an ordered plurality of sound sequences, electric power supply means connected to said base and supplying power to said control element, sound signal emission means housed in said first hemispherical half shell and being electrically connected to said control element, at least one pair of films fixed to said first hemispherical half-shell and to said second hemispherical half-shell, flattened surfaces defined on said first hemispherical half-shell and on said second hemispherical half-shell, a plurality of contact switches provided on said films at said flattened surfaces, a plurality of sensor elements defined by said plurality of contact switches, each of said sensor elements communicating with said electronic control element for selecting an electric signal among said plurality of electric signals transduced into sound signals and being activatable at said outside surface of said container, a membrane keyboard formed by said plurality of sensor elements, two substantially hemispherical membranes defined by said deformable covering membrane portion and being fixed on said outside surface of said substantially spherical container, each of said membranes having an inner membrane surface and an outer membrane surface, graphic symbol means defined on said outer membrane surface of each of said substantially hemispherical membranes for indicating sound sequences, and conductor means applied on said inner membrane surface of each of said hemispherical membranes beneath said graphic symbol means and being contactable with said contact switches.

2. The sound box device according to claim 1, wherein said first container portion defines a first hemispherical dome, wherein said second container portion defines a second hemispherical dome, and wherein said container portion connecting means comprise;

at least one hinge connected to said first hemispherical dome and to said second hemispherical dome, at least one slot formed in said first hemispherical dome diametrically opposite to said hinge, at least one tab connected to said other spherical dome diametrically opposite said hinge, and at least one tooth connected to said tab and elastically engaging said slot.

3. The sound box device according to claim 2 wherein said base has a substantially circular configuration, and wherein said first hemispherical dome has an inner surface, said inner surface having a plurality of teeth angularly distributed thereon, said plurality of teeth elastically locking said base to said first hemispherical dome.

4. The sound box device according to claim 1 wherein said electric power supply means comprise at least two electric batteries, and wherein said base comprises;

at least one support, at least two seats formed in said support, at least two heads defined by said support, and partition means interconnecting said heads and separating said at least two electric batteries from each other.

5. The sound box device according to claim 1 wherein said sound signal emission means comprises at least one loudspeaker having an emission diaphragm, said emission diaphragm being directed towards said base, at least one annuler ridge being provided on said first hemispherical half shell, said loudspeaker being centered on said annular ridge, said first hemispherical half shell having formed thereon a plurality of engagement teeth, said engagement teeth elastically locking said loudspeaker to said first hemispherical half shell.

6. The sound box defined in claim 1 wherein said plurality of contact switches comprise;

a circular terminal connected to each film on said pair of films on said first hemispherical half-shell and said second hemispherical half-shell.

7. The sound box device according to claim 1 wherein said conductor means comprises a graphite layer applied to said inner membrane surface of each of said hemispherical membranes.

8. The sound box device according to claim 1 wherein said ordered plurality of sound sequences produced by said plurality of electric signals transduced into sound signals by said electronic control element comprise national anthems, and wherein said graphic symbol means defined on said outer membrane surface of each of said substantially hemispherical membranes comprise a plurality of national flags, each of said national flags corresponding to one of said national anthems.

9. A sound box comprising:

a substantially spherical container having an outside surface, a first container portion and a second container portion, a first hemispherical half-shell defined by said first container portion, a second hemispherical half-shell defined by said second container portion, connecting means connecting said first container portion to said second container portion, wherein said first container portion and said second container portion each comprise:

a supporting frame portion,
a deformable covering membrane portion, and
coupling means attaching said deformable covering membrane portion to said supporting frame portion,
at least one base connected to said first container portion,
at least one control element having a microprocessor and being mounted on said base, said microprocessor producing a plurality of electric signals transduced into sound signals for producing an ordered plurality of sound sequences,
electric power supply means connected to said base and supplying power to said control element,
sound signal emission means housed in said first hemispherical half shell and being electrically connected to said control element,
at least one pair of films fixed to said first hemispherical half-shell and to said second hemispherical half-shell,
flattened surfaces defined on said first hemispherical half-shell and on said second hemispherical half-shell,
a plurality of contact switches provided on said films at said flattened surfaces,
a plurality of sensor elements defined by said plurality of contact switches, each of said sensor elements communicating with said electronic control element for selecting an electric signal among said plurality of electric signals transduced into sound signals and being activatable at said outside surface of said container,
a membrane keyboard formed by said plurality of sensor elements,
two substantially hemispherical membranes defined by said deformable covering membrane portion and being fixed on said outside surface of said substantially spherical container, each of said membranes having an inner membrane surface and an outer membrane surface,
graphic symbol means defined on said outer membrane surface of each of said substantially hemispherical membranes for indicating sound sequences, and
conductor means applied on said inner membrane surface of each of said hemisperical membranes beneath said graphic symbol means and being contactable with said contact switches,
wherein said plurality of contact switches comprise;
a circular terminal connected to each film on said pair of films on said first hemispherical half-shell and said second hemispherical half-shell.

10. The sound box device according to claim 9 wherein said first container portion defines a first hemispherical dome, wherein said second container portion defines a second hemispherical dome, and
wherein said container portion connecting means comprise;
at least one hinge connected to said first hemispherical dome and to said second hemispherical dome,
at least one slot formed in said first hemispherical dome diametrically opposite to said hinge,
at least one tab connected to said other spherical dome diametrically opposite said hinge, and
at least one tooth connected to said tab and elastically engaging said slot.

11. The sound box device according to claim 10 wherein said base has a substantially circular configuration, and wherein said first hemispherical dome has an inner surface, said inner surface having a plurality of teeth angularly distributed thereon, said plurality of teeth elastically locking said base to said first hemispherical dome.

12. The sound box device according to claim 9 wherein said electric power supply means comprise at least two electric batteries, and wherein said base comprises;
at least one support,
at least two seats formed in said support,
at least two heads defined by said support, and
partition means interconnecting said heads and separating said at least two electric batteries from each other.

13. The sound box device according to claim 9 wherein said sound signal emission means comprises at least one loudspeaker having an emission diaphragm, said emission diaphragm being directed towards said base, at least one annular ridge being provided on said first hemispherical half shell, said loudspeaker being centered on said annular ridge, said first hemispherical half shell having formed thereon a plurality of engagement teeth, said engagement teeth elastically locking said loudspeaker to said first hemispherical half shell.

14. The sound box defined in claim 9 wherein said conductor means comprise a graphite layer applied to said inner membrane surface of each of said hemispherical membranes.

15. A sound box device comprising:
a substantially spherical container having an outside surface, a first container portion and a second container portion,
a first hemispherical half-shell defined by said first container portion,
a second hemispherical half-shell defined by said second container portion,
connecting means connecting said first container portion to said second container portion, wherein said first container portion and said second container portion each comprise:
a supporting frame portion,
a deformable covering membrane portion,
coupling means attaching said deformable covering membrane portion to said supporting frame portion,
at least one base connected to said first container portion,
at least one control element having a microprocessor and being mounted on said base, said microprocessor producing a plurality of electric signals transduced into sound signals for producing an ordered plurality of sound sequences,
electric power supply means connected to said base and supplying power to said control element,
sound signal emission means housed in said first hemispherical half shell and being electrically connected to said control element,
at least one pair of films fixed to said first hemispherical half-shell and to said second hemispherical half-shell,
flattened surfaces defined in said first hemispherical half-shell and on said second hemispherical half-shell,
a plurality of contact switches provided on said films at said flattened surfaces,
a plurality of sensor elements defined by said plurality of contact switches, each of said sensor elements communicating with said electronic control element for selecting an electric signal among said plurality of electric signals transduced into sound signals and being activatable at said outside surface of said container, a membrane keyboard formed by said plurality of sensor elements, two substantially hemispherical membranes defined by said deformable covering membrane portion and being fixed on said outside surface of said substantially spherical container, each of said membranes having an inner membrane surface and an outer membrane surface, graphic symbol means defined on said outer membrane surface of each of said substantially hemispherical membranes for indicating sound sequences, and conductor means applied on said inner membrane surface of each of said hemispherical membranes beneath said graphic symbol means and being contactable with said contact switches, wherein said plurality of contact switches comprise:

a circular terminal connected to each film on said pair of films on said first hemispherical half-shell and said second hemispherical half-shell, and wherein said conductor means comprise a graphite layer applied to said inner membrane surface of each of said hemispherical membranes.

16. The sound box device according to claim 15 wherein said first container portion defines a first hemispherical dome, wherein said second container portion defines a second hemispherical dome, and wherein said container portion connecting means comprise;

at least one hinge connected to said first hemispherical dome and to said second hemispherical dome, at least one slot formed in said first hemispherical dome diametrically opposite to said hinge, at least one tab connected to said other spherical dome diametrically opposite said hinge, and at least one tooth connected to said tab and elastically engaging said slot.

17. The sound box device according to claim 16 wherein said base has a substantially circular configuration, and wherein said first hemispherical dome has an inner surface, said inner surface having a plurality of teeth angularly distributed thereon, said plurality of teeth elastically locking said base to said first hemispherical dome.

18. The sound box device according to claim 15 wherein said electric power supply means comprise at least two electric batteries, and wherein said base comprises:

at least one support, at least two seats formed in said support, at least two heads defined by said support, and partition means interconnecting said heads and separating said at least two electric batteries from each other.

19. The sound box device according to claim 15 wherein said sound signal emission means comprises at least one loudspeaker having an emission diaphragm, said emission diaphragm being directed towards said base, at least one annuler ridge being provided on said first hemispherical half shell, said loudspeaker being centered on said annular ridge, said first hemispherical half shell having formed thereon a plurality of engagement teeth, said engagement teeth elastically locking said loudspeaker to said first hemispherical half shell.

20. The sound box device according to claim 15 wherein said ordered plurality of sound sequences produced by said plurality of electric signals transduced into sound signals by said electronic control element comprise national anthems, and wherein said graphic symbol means defined on said outer membrane surface of each of said substantially hemispherical membranes comprise a plurality of national flags, each of said national flags corresponding to one of said national anthems.

* * * * *